United States Patent [19]

Quirke

[11] 4,167,689

[45] Sep. 11, 1979

[54] SOLID STATE LAMP BALLAST

[75] Inventor: Patric C. Quirke, Whitewater, Wis.

[73] Assignee: Whitewater Electronics, Inc., Whitewater, Wis.

[21] Appl. No.: 926,938

[22] Filed: Jul. 21, 1978

[51] Int. Cl.[2] ..... H05B 41/26

[52] U.S. Cl. ..... 315/206; 315/208; 315/244; 315/278; 315/DIG. 7

[58] Field of Search ..... 315/206, 208, 244, 289, 315/278, DIG. 7

[56] References Cited

U.S. PATENT DOCUMENTS

| | | | |
|---|---|---|---|
| 3,309,566 | 3/1967 | Michalski | 315/206 X |
| 3,544,839 | 10/1968 | Fahnrich | 315/206 X |
| 3,628,086 | 12/1971 | Nuckolis | 315/244 X |

*Primary Examiner*—Alfred E. Smith
*Assistant Examiner*—Charles F. Roberts
*Attorney, Agent, or Firm*—Ira Milton Jones

[57] ABSTRACT

A lamp ballast connectable with a d.c. source comprises a regulating device having a voltage coil and a load coil. The voltage coil is connected in a circuit in parallel with the series-connected load coil and lamp. Alternate charge and discharge of a capacitor connected with the voltage coil impresses an alternating voltage thereacross. The capacitor is charged by current through the voltage coil and is discharged through a resonant commutating circuit comprising a thyristor triggered from an oscillator pulse circuit at a frequency of several KHz. The commutating circuit, which has a resonant frequency about twice that of the oscillator, further comprises a commutating reactor having substantially lower impedance than the load and voltage coils, a back current diode, and a resistance-capacitance dV/dt clamp that reduces back voltage spikes across the thyristor to safe rates of rise. Interaction between the load coil and the commutating reactor and/or voltage coil ensures adequate current limiting when resistance across the lamp terminals is low but permits high enough voltage for ignition when that resistance is effectively infinite. Preferred component values are specified for ballasts useable with mercury and low pressure sodium lamps rated at 100W and under.

19 Claims, 7 Drawing Figures

SOLID STATE LAMP BALLAST

This invention relates to lamp ballast apparatus by which a high voltage can be impressed across a lamp during a starting period in which the lamp has a high resistance, but by which current through the lamp is limited when lamp resistance drops substantially upon so-called ignition; and the invention is more particularly concerned with a solid state ballast for ballasted lamps that is competitive in cost with comparable ballast apparatus heretofore available but is nevertheless lighter and much more efficient.

The type of ballast heretofore most commonly used for mercury arc and other lamps rated for power consumption of up to about 100 watts and requiring ignition voltages on the order of 180 to 500 volts comprised a transformer, an autotransformer, or a reactor. See "What You Should Know About HID Ballasts" by Ernest Freegard in Electrical Construction & Maintenance, February, 1973, p. 3. Because of their weight and bulk, such prior devices were poorly suited for portable lighting units and for fixed installations in which a ballasted lamp was mounted at the top of a high standard and its ballast had to be located near the lamp.

A more important objection to such prior ballasts was that they were expensive and wasteful in operation. When used with a lamp rated at 50 watts or less, such a ballast consumed about half as much power as the lamp itself. Efficiency was higher for such a ballast used in combination with a lamp rated at upwards of 100 watts, but in every case the ballast had a disproportionately high energy consumption for a device that performed only a control function.

Such prior ballasts also had a power factor of about 50%. Power factor correction was rarely feasible from a cost standpoint, and therefore the use of large numbers of lamps equipped with such ballasts imposed a burden upon electrical generating utilities with respect to both energy consumption and equipment requirements.

In an effort to avoid certain of the disadvantages of prior ballast apparatus comprising autotransformers and the like, various types of solid state ballasts have been devised, intended to achieve smaller weight and bulk, lower cost, more efficient performance, or some combination of these. See "Solid State Ballasting of Fluorescent and Mercury Lamps" by B. M. Wolfframm, in IEEE Conference Record of Fourth Annual Meeting of Industry and General Applications Group, 1969, p. 381–385. However, as becomes apparent with careful reading of the Wolfframm article, all of the solid state ballast devices heretofore proposed have failed to satisfy one or more of the several requirements for a completely satisfactory ballast.

One such requirement is that the ballast provide for energization of the lamp with an alternating current having a substantially sinusoidal wave form. Lamp life is adversely affected by energization with pulsed d.c. or with a.c. having a square waveform. The frequency of the energizing a.c. should be substantially above the conventional 50 or 60 Hz line frequency, not only to avoid the stroboscopic flicker that is noticeable at line frequencies but to take advantage of the increase in lumens-per-watt lamp output that is obtained with increasing frequency up to frequencies of a few thousand Hz, with no fall-off at still higher frequences.

Most of the solid state ballasts heretofore proposed have provided for lamp energization with alternating or pulsing currents having frequencies high enough to avoid strobe flicker and to afford a substantially optimum output in lumens per watt. Nevertheless, prior solid state ballasts could not be regarded as truly efficient, even though they were in most cases somewhat more efficient than the older and heavier ballasts. At best, solid state ballasts have had efficiencies on the order of 75% when used with lamps rated at 100 watts or lower. The marginally greater efficiency of prior solid state ballasts was offset by higher cost to such an extent that the older and heavier devices continued to be widely used. The desirability of a substantially more energy-efficient ballast has undoubtedly been appreciated since the day the first ballasted lamp was put into operation, but evidently the attainment of much over a 75% ballast efficiency for lamps of 100 watts and under has heretofore eluded even the highest skill in the art.

To be completely satisfactory, a ballast should not only be inexpensive, efficient, light and compact, but should also be capable of surviving certain conditions that are not encountered in normal lamp operation but are by no means unusual. Thus, at starting, the ballast must necessarily accommodate itself to high resistance across the terminals of the lamp that it controls, and must provide the necessary high voltage across those terminals; but it should also be capable of surviving an idefinite continuance of an open circuit condition such as can occur if the lamp is removed from its socket and its energizing circuit is turned on and left on. In like manner, the ballast must provide adequate current regulation when the lamp is in full operation with a low resistance across its terminals; but a ballast—especially one that is intended for use with mercury arc lamps—should also be capable of surviving indefinitely with a direct short circuit across the lamp terminals. Most prior ballasts of the transformer and autotransformer type were not capable of surviving for any substantial period when the lamp terminals were shorted. The less expensive solid state ballasts heretofore devised seem to have been incapable of surviving continuance of one or both of the open-circuit and short-circuit conditions, and such prior solid state ballasts as were capable of long-time survival of both of those conditions were complicated and more costly than the more common transformer and autotransformer devices.

With the foregoing considerations in mind, it is the general object of this invention to provide ballast apparatus for a lamp of the character described which is substantially less heavy and bulky than prior commonly used comparable ballasts, but which is nevertheless substantially more efficient than any prior ballast and, moreover, is capable of surviving indefinitely not only under normal operating conditions but also under short-circuit and open-circuit conditions.

It is also a general object of this invention to provide a solid state ballast which is, at worst, only slightly higher in first cost than comparable prior ballasts of the least expensive kinds but is so much lighter and smaller that savings in freight costs are often sufficient to offset the difference in price to the ultimate purchaser, and which is so much more efficient than prior ballasts that savings in electric power over a short period of use will in every case more than compensate for any difference in cost of the ballast itself.

Specifically, it is an important object of this invention to provide a solid state ballast which is particularly advantageous for use with mercury arc and low pressure sodium vapor lamps rated at 100 watts and under, in that said ballast has an efficiency of at least 85% with such lamps, provides for optimum lamp output in lumens per watt, and has a power factor on the order of 0.98.

Another and more specific object of the invention is to provide ballast apparatus that is particularly suitable for a lamp which requires about 180 to 500 volts for ignition and which requires an energizing power of up to about 100 watts, which ballast is connectable with a d.c. source and is therefore connectable with either a d.c. line, a battery, or a source of rectified a.c.

Another specific object of this invention is to provide a light, compact, low cost ballast for a lamp of the character described, which ballast has a power factor of nearly unity and operates with very high efficiency in that it consumes no more than about ten percent of the power fed to the circuit in which the ballast is connected with the lamp that it controls, said ballast being further efficient in that it provides for energization of the lamp with an alternating current having a frequency on the order of several KHz (typically 15 to 25 KHz), thus enabling the lamp to produce a high output in lumens per watt.

It is also a specific object of this invention to provide simple and inexpensive ballast apparatus wherein an alternating voltage at a frequency of several KHz is impressed across a reactive regulating circuit by means of a capacitor, and wherein the capacitor cooperates with a commutating circuit that comprises a thyristor and provides for alternate charge and discharge of the capacitor.

Another specific object of this invention is to provide a ballast which, with little or no modification of a particular device embodying the invention, can be interchangeably cooperable with mercury arc lamps and low pressure sodium lamps, which ballast comprises a reactive voltage and current regulating device and means for impressing across that device an alternating voltage of a frequency high enough to enable the reactive device to be very inexpensive, light and compact.

It is also an object of this invention to provide a ballast of the character described which, in certain of its embodiments, provides for isolation of the ballasted lamp from the supply line.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

The accompanying drawings illustrate several complete examples of the embodiments of the invention constructed according to the best modes so far devised for the practical application of the principles thereof, and in which.

Figure 2:
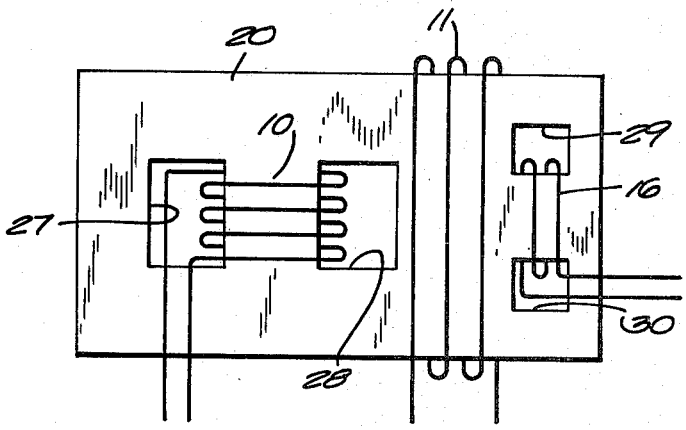
FIG. 2 is a more or less diagrammatic view of a reactor device preferred for use in the FIG. 1 circuit.
Figure 5:
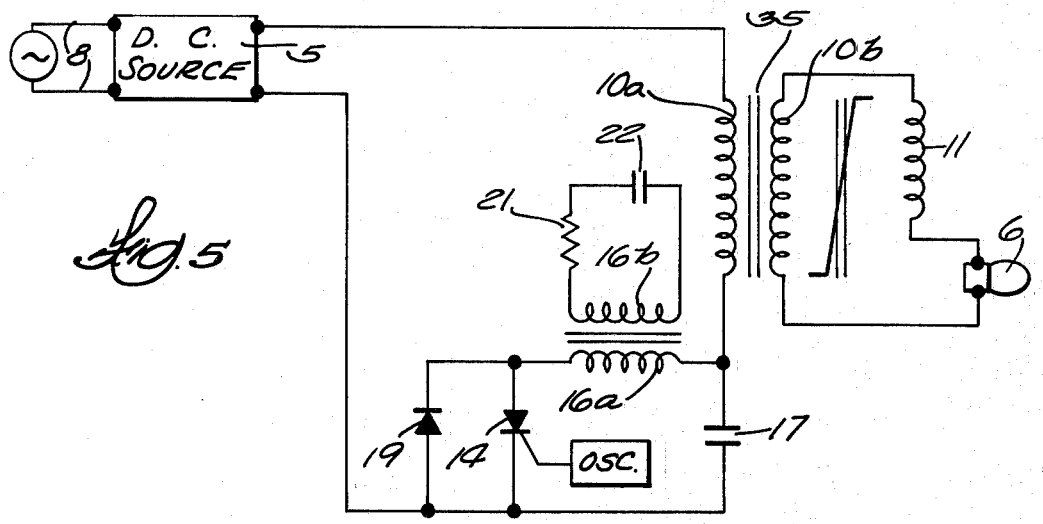
Figure 6:
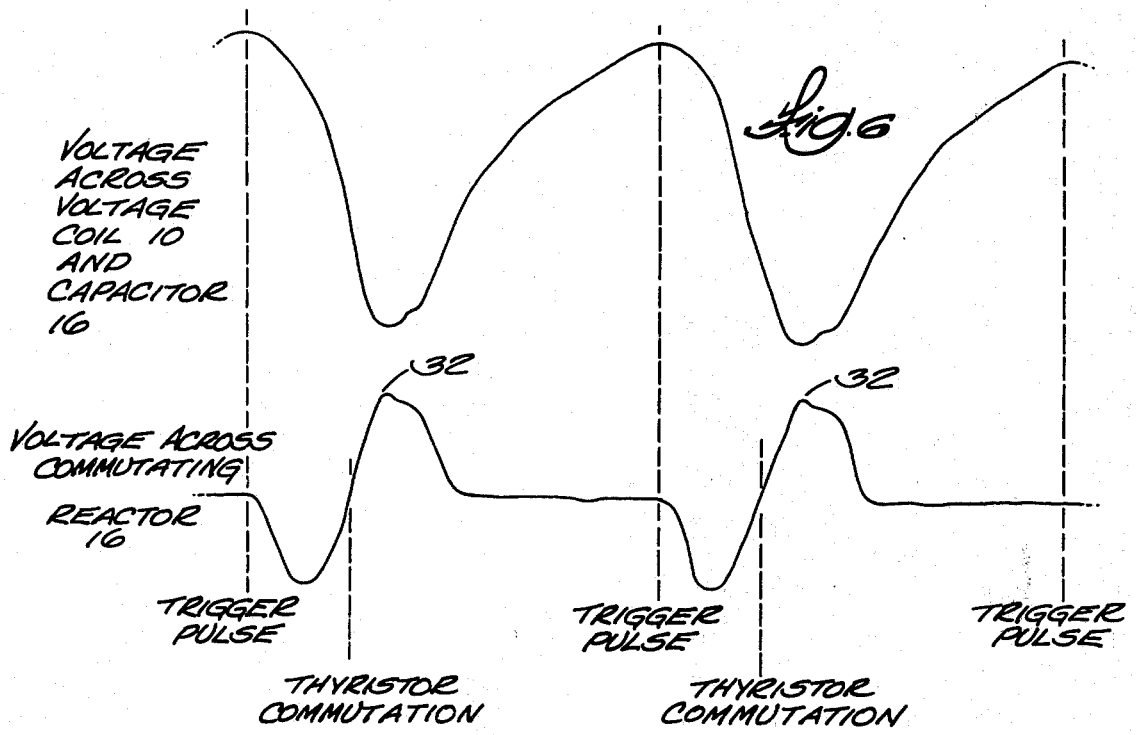
Figure 7:
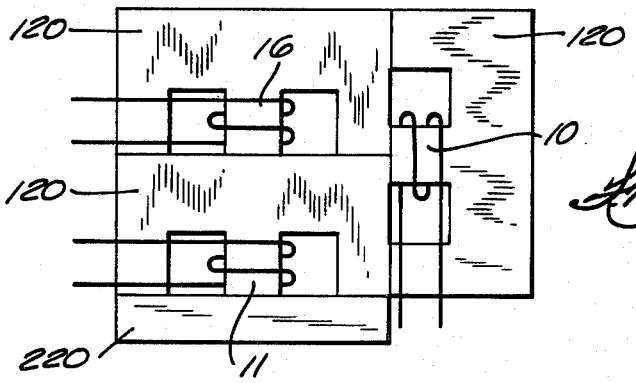

FIG. 5 is a circuit diagram of a further modified embodiment of the ballast apparatus; and FIG. 6 is a time-voltage diagram illustrating voltages across the voltage coil in relation to voltages across the commutating reactor under closed circuit conditions; and FIG. 7 is a view generally similar to FIG. 2 but illustrating a form of reactor device which has been found advantageous under some conditions.

Referring now to the accompanying drawings, the ballast apparatus of this invention, which is generally designated by 4, is intended to be connected with a source 5 of direct current and with a lamp 6, and it serves for controlling energization of the lamp from the current source. Typically the lamp 6 is a low pressure sodium lamp or a mercury lamp, rated at 100 watts or less and requiring 180 to 500 volts rms for starting but presenting a d.c. resistance after being fully ignited that is substantially lower than its d.c. resistance during ignition, and thus requiring current limiting during its normal operation. The principles of the invention seem to be applicable to ballasts for high pressure HID and metal halide lamps that require substantially high ignition voltages, on the order of 2500 to 4000 volts, and to ballasts for fluorescent lamps, but tests have not been made with any of these.

As shown, and as will be preferred for most practical cases, the d.c. current source 5 comprises a conventional full-wave rectifier bridge circuit 7 that has its input terminals connected with alternating current mains 8. In the following explanation it is assumed that the a.c. mains 8 constitute a conventional 115-volt supply. Connected across the output terminals of the bridge network 7 is a filtering capacitor 9 that has sufficient capacitance (typically, 100 $\mu$fd) to ensure that the d.c. fed to the ballast apparatus 4 will be steady and substantially free from ripples. It will be obvious that for most applications the rectifier bridge 7 and the ripple filter capacitor 9 will be assembled into a permanently packaged unit with the ballast apparatus 4.

The ballast apparatus 4 comprises, in general, a reactive current and voltage regulating device 9 that has a voltage coil 10 and a load coil 11, and a commutating circuit 12 in which there is a solid state switching device 14 that is illustrated as a thyristor, specifically an SCR. An oscillator or clock circuit 15 is connected with the gate of the thyristor 14 to supply triggering pulses to it at regular intervals. In addition to the thyristor 14, the commutating circuit 12 comprises a commutating reactor 16 that has a much lower inductance than either of the coils 10 or 11 of the regulating device, a capacitor 17 that also cooperates directly with the regulating device 9, and a fast recovery diode 19 arranged to pass back currents across the thyristor 14.

The clock or oscillator circuit 15 issues trigger pulses to the thyristor 14 at a frequency on the order of several KHz, preferably in the range of 13 to 25 KHz. Since various circuits are known by which such a pulsed output can be produced, details of the clock or oscillator circuit 15 are not illustrated. In practice that circuit will usually be energized from the d.c. source comprising the rectifier bridge 7 and will usually be packaged along with that d.c. supply and the ballast circuitry. Since the oscillator is employed for triggering the thyristor 14, the oscillator output pulses should have a relatively fast rise time and pulse duration should be relatively short, that is, the interval between successive pulses should be substantially longer than the pulses themselves.

The reactive regulating device 9 is in a regulating circuit having two parallel branches. One branch can be regarded as a load branch and comprises the load coil 11 in series with the lamp 6. The other branch consists of the voltage coil 10. In the illustrated embodiments the load branch is connected across the terminals of the voltage coil, but it will be evident as the description proceeds that the load branch could also be connected across the voltage coil in series with the commutating reactor 16. The voltage coil is in every case connected in series with the commutating reactor 16 and the anode and cathode terminals of the thyristor 14, and in turn that series circuit is connected across the output terminals of the d.c. source 5.

The thyristor 14 and the commutating reactor 16 are also connected with the capacitor 17 to comprise therewith the resonant commutating circuit 12, whereby the thyristor, after being gated on by the oscillator circuit 15, is commutated (turned off) by a back voltage impressed across it.

Considering the operation of the apparatus in a rather general way, the voltage coil 10 serves as a source of voltage for the load branch 6, 11 of the regulating circuit, inasmuch as the voltage across the terminals of the voltage coil is impressed across the load branch. The capacitor 17 is connected with both the commutating circuit and the regulating circuit. In its connection with the regulating circuit the cooperation of the capacitor 17 with the voltage coil 10 is particularly significant, since the function of the capacitor is to impress an alternating voltage across that coil. The capacitor does this in consequence of being alternately charged through the regulating circuit and discharged through the commutating circuit.

It will be apparent that if the thyristor 14 has not been gated on for some time, the capacitor 17 will have been charged through the regulating device 9. When the thyristor 14 then receives a triggering pulse, the capacitor 17 discharges through the thyristor and the commutating reactor 16. During the discharge of the capacitor 17, owing to the inductance of the reactor 16 that is in the commutating circuit with it, a condition is reached at which there is a back voltage across the thyristor 14. The thyristor is thereby commutated (turned off) so that no further current can flow through it until it receives the next triggering pulse. However, the fast recovery diode 19, which is connected across the thyristor, provides for back flow of current across the thyristor during a portion of the cycle that begins at commutation of the thyristor, and through the diode 19 the capacitor 17 begins to be recharged to its initial condition. Flow of current through the diode 19 terminates a substantial time before the next trigger pulse is delivered to the thyristor; but charging of the capacitor 17 nevertheless continues, being effected through the regulating device 9, so that there is a substantial forward voltage across the thyristor 14 when the time arrives for delivery of the next trigger pulse to it.

The entire commutation cycle, during which current flows through the thyristor 14 and then through the diode 19, takes place during only a part of the interval between trigger pulses because the resonant frequency of the commutating circuit 12 is substantially higher than the pulse frequency of the oscillator 15. By reason of this frequency relationship, the commutation cycle initiated by a particular trigger pulse will be completed before the next succeeding trigger pulse is issued, so that the oscillator 15 will always deliver a trigger pulse when there is a forward voltage across the thyristor 14 and will thus have control over the commutating cycle. Preferably the resonant frequency of the commutating circuit is on the order of twice the oscillator pulse frequency.

FIG. 6 illustrates the approximate time relationship, under closed-circuit conditions, between voltages across the commutating reactor 16 and voltages across the capacitor 17, the latter voltages also being impressed across the voltage coil 10.

It will be evident that there is a flow of current between the terminals of the d.c. source 5 only intermittently, as current is drawn through the regulating device 9 during a part of the charge-discharge cycle of the capacitor 17. The alternating voltage which the capacitor 17 impresses across the voltage coil 10 can therefore be regarded as riding on top of an intermittent direct current flow.

Before proceeding to an explanation of how the regulating device 9 performs its current and voltage regulating functions, attention should be given to certain important impedance relationships. The inductive impedance of the voltage coil 10 is very much higher than that of the commutating reactor 16, so that the impedance of the voltage coil has no significant effect upon the resonant frequency of the commutating circuit 12. The inductive impedance of the load coil 11, although lower than that of the voltage coil 10, is at least six times that of the commutating reactor 16. By way of a specific example, the inductance of the commutating reactor 16 is about 250 microhenries at the resonant frequency (typically 47 KHz) of the commutating circuit. The inductance of the voltage coil 10 is typically about 400 times that of the commutating reactor, i.e., 100 milihenries at a typical 23.5 KHz operating frequency for the ballast apparatus. With this inductance, the voltage coil has an impedance of about 16,000 ohms, although its d.c. resistance is on the order of 7 ohms. With the voltage coil and commutating reactor just specified, the load coil 11 has an inductance of about 1.7 milihenries at the operating frequency, and its impedance is on the order of 250 ohms.

For an understanding of the operation of the regulating device 9, consideration must be given to both the open-circuit condition, in which there is no current flowing in its load branch (i.e., effectively infinite resistance across the terminals of the lamp 6) and closed-circuit conditions on which there is a finite or practically zero resistance across the lamp terminals and there is flow of current through the load coil 11. The open-circuit condition exists for a short time prior to the ignition of a lamp, and of course it can exist for an indefinite time if the lamp is removed from its socket and the ballast apparatus is energized. Closed-circuit conditions normally exist during stable, fully ignited lamp operation; and the short circuit condition, which is a special kind of closed-circuit condition, prevails briefly during the ignition of a mercury lamp and can exist indefinitely in consequence of failure of such a lamp.

In the open-circuit condition, current through the voltage coil 10 is limited by the series-connected impedances of that coil and of the commutating circuit 12. Voltage across the voltage coil 10 is dependent upon the current through it and its impedance, and in the open-circuit condition is typically about 500 volts, peak, which is high enough for ignition of both mercury lamps and low pressure sodium lamps. The full voltage across the voltage coil 10 is of course impressed across the lamp terminals in the open-circuit condition, inasmuch as there is then no current flow through the load coil 11.

When resistance across the lamp terminals drops to a finite value, and current begins to flow through the load branch 6, 11 of the regulating circuit, the load coil 11, by reason of its relatively high impedance, performs a current limiting function. Furthermore, the amount of current drawn through the two parallel branches of the regulating circuit is limited by the impedance of the commutating circuit 12; hence, even in the absence of any interaction between the load coil 11 and the commutating reactor 16, or between the load coil and the voltage coil 10, current through the voltage coil would be less under closed-circuit conditions than in the open-circuit condition, and therefore the voltage across the voltage coil would be lower. In turn, because of the lower voltage across the voltage coil, less current would be forced through the lamp. Hence a ballast apparatus not having either of the interactions just mentioned would nevertheless have voltage and current limiting capabilities and might be satisfactory for some lamps.

However, to obtain high ballast efficiency when the lamp is in normally lighted operation, but still provide for an open-circuit voltage across the voltage coil 10 that is high enough to ensure reliable ignition, there is preferably an interaction between the commutating reactor 16 and the load coil 11, achieved by winding them on a common core as described hereinafter. By reason of that interaction, current through the load coil 11 causes an effective increase in the impedance of the commutating reactor 16; and therefore the commutating circuit draws less current through the regulating device 9 when there is a finite resistance across the lamp terminals (and even with a short circuit at those terminals) than it draws through the voltage coil 10 in the open-circuit condition.

Inasmuch as such interaction between the load coil 11 and the commutating reactor 16 affects the impedance of the commutating reactor but not that of the capacitor 17, flow of current through the load coil 11 causes an increase in the resonant frequency of the commutating circuit, and the increased impedance of the commutating reactor is therefore manifested in a shortened commutating cycle. That is to say that, as compared with the open-circuit condition, under closed-circuit conditions the capacitor 17 is discharged during a smaller portion of the fixed interval between oscillator trigger pulses; therefore it discharges to a lesser extent during each cycle; and therefore less current is drawn through the regulating device 9. With a proper selection of circuit parameters, the interaction between the load coil 11 and the commutating reactor 16 can be so controlled as to cause less current to be drawn in the short-circuit condition than during normal, fully ignited lamp operation. The described interaction between the load coil 11 and the commutating reactor 16 has the additional advantage that current through the commutating reactor tends to increase the effective impedance of the load coil, so that a load coil of the required impedance can be obtained with somewhat less wire than would be needed in the absence of such interaction.

As an alternative to interaction between the load coil 11 and the commutating reactor 16, or in addition to such interaction, there can be an interaction between the load coil and the voltage coil 10, provided for in another embodiment of the invention as explained hereinafter. With the load coil and voltage coil arranged for such interaction, current through each of those coils tends to increase the effective impedance of the other. By reasons of such interaction, the regulating device can have a net impedance which is no greater under closed-circuit conditions, when current flows through both of its branches, than in the open circuit condition when current flows only through the voltage coil 10.

To achieve the necessary high inductances with minimum weight and bulk, the saturable reactor 16 as well as each of the coils 10 and 11 should be coupled with a magnetically permeable core, preferably of ferrite or the like to minimize losses at the high frequencies at which the apparatus operates. Although FIG. 1 indicates that each of the inductive components is wound on a separate core, FIG. 2 illustrates an arrangement which is preferred not only for its low cost but for the more important reason that is provides the desirable interaction, discussed above, between the load coil 11 and the commutating reactor 16.

The device shown in FIG. 2 comprises a single rather elongated rectangular core 20 that has two windows 27 and 28 through which the voltage coil 10 is wound. The load coil 11 surrounds the core at one side of the pair of windows 27, 28 and has its axis at right angles to that of the voltage coil, so that there is no substantial interaction between those coils. If current through one of the coils 10 or 11 could induce a flux in the core 20 that nearly or completely saturated the portion of the core around which those coils are wound, there would be an undesirable reduction in the effective impedance of the other coil; and to avoid this, the device is so designed that said portion of the core is subjected to flux densities that are confined to the substantially linear portion of its hysteresis curve.

To provide for the desired interaction between the commutating reactor 16 and the load coil 11, the commutating reactor comprises a coil that is wound through two additional windows 29 and 30 in the core 20, located at the side of the load coil 11 that is remote from the windows 27, 28 through which the voltage coil 10 is wound. The windows 29 and 30 are so arranged as to dispose the axis of the commutating reactor coil 16 parallel to that of the load coil 11. Since current through the commutating reactor 16 is 180° out of phase with current through the load coil 11, the fluxes due to those currents oppose one another in the portion of the core 20 around which the commutating reactor coil 16 is wound. Thus, current through each of those coils increases the effective impedance of the other, but, because of the substantially lower impedance of the commutating reactor, it is influenced by this interaction to a greater extent than the load coil 11.

This interaction between the load coil 11 and the commutating reactor 16 is especially advantageous when the ballast is used with a mercury lamp. During ignition, such a lamp goes almost instantaneously from an open circuit condition to what is practically a short circuit condition, after which resistance across its terminals rises as the lamp heats. Since the transition from open-circuit to short-circuit takes place in a fraction of an operating cycle of the ballast, it could result—in the absence of the above described interaction—in a tremendous surge of current through the load coil 11 that would, in effect, overwhelm the commutating circuit. With the FIG. 2 arrangement, this abrupt transition situation presents no problem. Obviously the interaction between the coils 11 and 16 is advantageous in a continuing short circuit condition because the high current that tends to flow in the load coil 11 increases the effective impedance of the commutating reactor 16, thereby reducing current flow through the commutating circuit, while at the same time the impedance of the load coil 11 is maintained at a maximum value by its interaction with the commutating reactor 16, so that current flow through the load coil likewise tends to be minimized. In fact, with proper design a ballast embodying the principles of this invention will consume less power in a short circuit condition than during normally ignited lamp operation. Although it consumes slightly more power in the open-circuit condition than in the short circuit condition, its open-circuit power consumption is a little less than during normal lamp operation, owing to the high impedance of the voltage coil 10 and the fact that the load branch of the regulating device is effectively out of the circuit.

Figure 4:
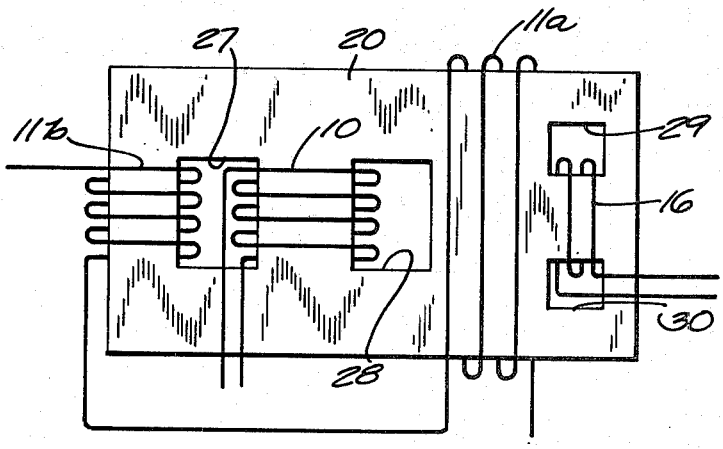
FIG. 4 is a view generally similar to FIG. 2 but illustrating a form of reactor device suitable for incorporation in the FIG. 3 circuit.

In the reactive regulating device that is illustrated in FIG. 4 there is an interaction between the load coil 11*a*, 11*b* and the voltage coil 10 as well as between the load coil and the commutating reactor 16. In this case the core 20 is essentially identical with the core of the device shown in FIG. 2, and the voltage coil 10 and the commutating reactor 16 are arranged like their counterparts in FIG. 2. However, the load coil is in two parts, one of which is designated 11*a* and surrounds the core between the pairs of windows 27, 28 and 29, 30, being much like the complete load coil 11 of FIG. 2 (but having a substantially lesser number turns) and interacting in a similar way with the commutating reactor 16. The other part 11*b* of the load coil in FIG. 4 is wound through the window 27 and around the exterior of the core, to have its axis parallel to the axis of the voltage coil 10. Bearing in mind that current in the load coil 11*a*, 11*b* is in phase with current in the voltage coil 10, it will be apparent from FIG. 4 that the flux which the load coil part 11*b* induces in the portion of the core embraced by it is in opposition to flux induced in the core by current through the voltage coil 10. By reason of this partial opposition between load coil induced flux and voltage coil induced flux, current through each of those coils increases the effective impedance of the other. Since current flows through the voltage coil 10 under all operating conditions, the net effective impedance of the load coil 11*a*, 11*b* can be higher, for a given number of turns of wire, than it would be for the simple load coil 11 of the FIG. 2 device. However, the saving in wire may be offset by the greater amount of labor needed for winding and connecting the two load coil parts 11*a*, 11*b* in the FIG. 4 device, so that the choice as between FIG. 2 and FIG. 4 depends upon prevailing cost conditions.

It will be apparent that the entire load coil could be wound at the location shown for the load coil part 11*a*, but in the case the core would have to be relatively large to permit the window 27 to be big enough to accommodate both of the coils wound therethrough, and the commutating reactor 16 would have to be relocated and rearranged to provide for its interaction with the load coil. FIG. 7 illustrates a form of reactor device consisting of three E-shaped core elements 120 and an I-shaped core element 220. The device shown in FIG. 7 has been found advantageous to minimize leakage flux that would otherwise produce inductive heating of a metal container in which the devise is housed, in addition to having obvious production advantages. From FIGS. 2, 4 and 7 and the foregoing descriptions of their operation, a variety of other modified embodiments of the reactive regulating device 9 will suggest themselves to those skilled in the art.

From the description to this point, it will be apparent that, however embodied, the voltage and current regulating device 9 can be relatively light and compact, owing to the comparatively high operating frequency of the ballast apparatus, which enables the coils 10 and 11 and the commutating reactor to have substantially high impedances even though they are wound with relatively few turns of wire.

However, the relatively high resonant frequency of the commutating circuit 12 requires that attention be given to certain features of that circuit. To ensure that the oscillator 15 will be able to control the commutation cycle by delivering a triggering pulse only when there is a forward voltage across the thyristor 14, the resonant frequency of the commutating circuit should be at least 1.2 times the oscillator frequency, although the ratio is preferably higher from the standpoint of cost of the capacitor 17. On the other hand, if the commutating circuit resonant frequency is more than about three times the pulse frequency, the impedance of the commutating circuit will tend to be too high in relation to that of the regulating circuit, and the lamp will receive insufficient current for normal operation. Preferably the resonant frequency of the commutating circuit is about 1.8 to 2 times the pulse frequency, typically 43 to 47 KHz pulse frequency.

Figure 1:
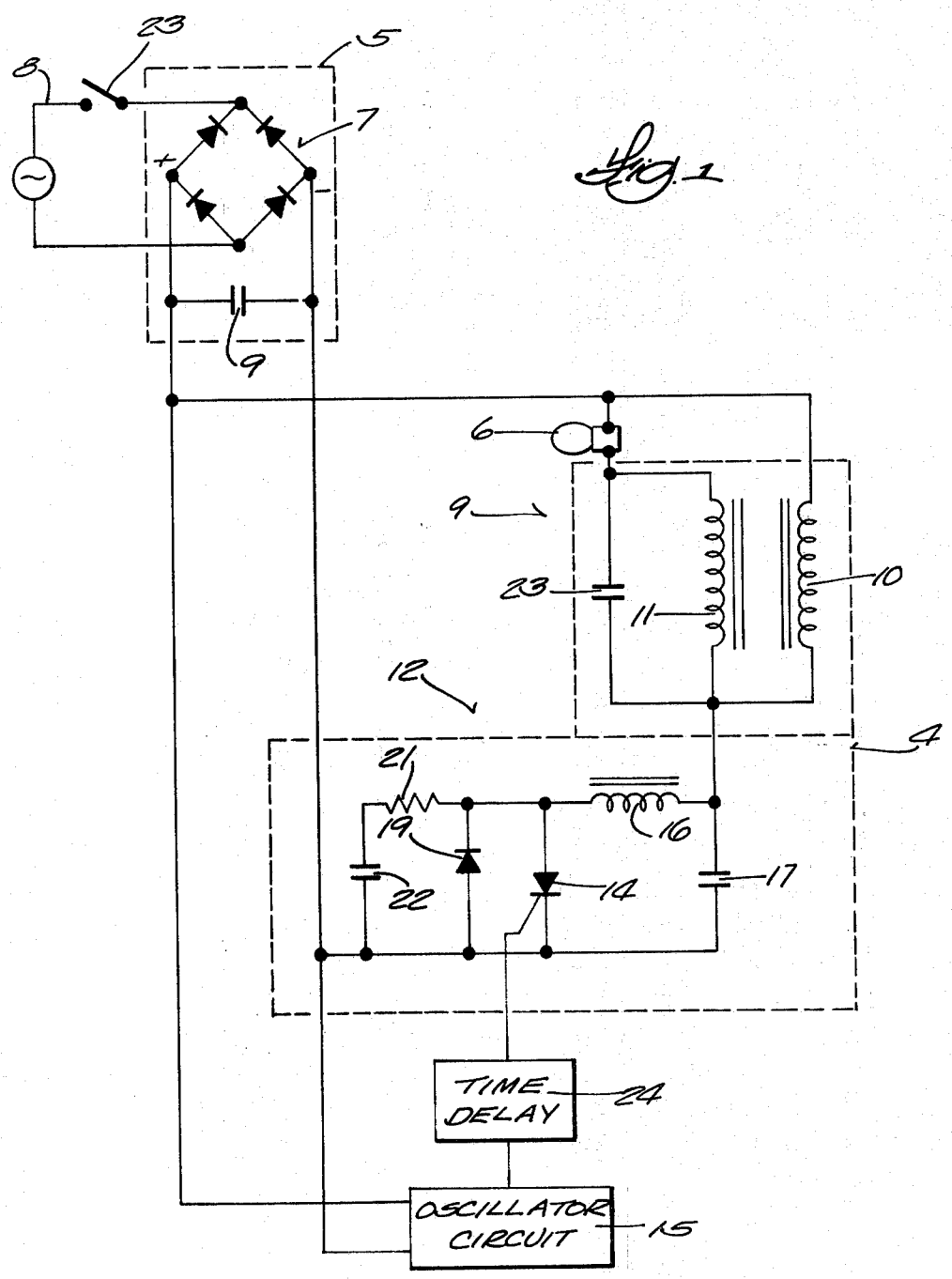
FIG. 1 is a circuit diagram of a preferred embodiment of a lamp ballast embodying the principles of this invention.

The high resonant frequency of the commutating circuit 12 tends to cause a very rapid rise of back voltage across the thyristor 14 upon its being commutated. Since there is a limit to the rate of rise of back voltage that a thyristor can sustain, the back voltage spike that tends to develop at commutation of the thyristor 14 is controlled and partially suppressed by a dV/dt clamp that is connected in the commutating circuit and consists of a resistor 21 and a capacitor 22 that are connected in series with one another. As shown in FIG. 1, the dV/dt clamp 21, 22 is shunted across the thyristor 14 and also, of course, across the fast-recovery diode 19.

The thyristor 14 is preferably a high speed SCR rated at 5 amps. and 750 volts. A preferred SCR for the purpose is an RCA S3900, designed for IV receiver horizontal deflection circuits, which has an integral fast recovery diode that serves as the diode 19. That device is capable of sustaining a maximum back voltage rise of 400 to 450 volts per microsecond, and when it is used as the thyristor 14, the time constant of the resistance-capacitance voltage-rise clamp 21, 22 is so selected as to limit the rate of rise of back voltage across it to about 300 volts per microsecond, thus assuring a substantial margin of safety. With a typical commutating circuit resonant frequency on the order of 45 KHz, resistor 21 is rated at 100 ohms and capacitor 22 at 2800 pfd.

Ideally, from the standpoint of lamp energization, the current through the commutating reactor 16 would have a sine wave form, but of course the second half of the wave form tends to be deformed by the back voltage spike that occurs at commutation of the thyristor. With the values just given, the dV/dt clamp 21, 22 smooths the second half of the wave to more nearly a sine configuration than it would have without clamping, but there is still some ripple in the second half of the wave form, as indicated at 32 in FIG. 6. However, since power is consumed in the clamping function, dV/dt clamping is preferably limited to that which is necessary for protection of the SCR, and the result is a very satisfactory compromise between the ideal wave form and unnecessary power dissipation.

Inasmuch as energy is consumed in the dV/dt clamp and is applied to heating the resistor 21, that resistor should be an appropriately rated one, preferably 15 watts, although a 7 watt resistor has been used successfully. Obviously the resistor 21 should either have adequate ventilation or a suitable heat sink.

The amount of dV/dt clamping that is needed for protection of a given thyristor is dependent upon the resonant frequency of the commutating circuit, which is in turn related to the pulse frequency of the oscillator circuit 15, as explained above. For the most suitable thyristors now available, pulse frequency should be on the order of about 13 to 25 KHz, preferably near the top of that range. Pulse frequencies substantially higher than 25 KHz would cause the back voltage spike that develops at commutation of the thyristor 14 to be so large that it would be difficult or uneconomical to provide a satisfactory dV/dt clamp 21, 22. Pulse frequencies below about 13 KHz would require the capacitor 17 to be uneconomically large. With the preferred frequencies, the capacitor 17 has a capacitance of 0.07 μfd, and it is preferably rated at 1600 volts so that it can adequately sustain the high voltages needed for ignition and occurring in the open circuit condition. In some cases cost can be reduced by using plural smaller capacitors in parallel, to comprise the capacitor 17, and in such cases if the commutating reactor 16 is wound with twisted multistrand Litz wire, as is preferred, individual smaller capacitors are connected with individual strands of the Litz wire to ensure uniform current distribution.

The commutating circuit 12 through which the capacitor 17 is discharged has an impedance that varies with the ratio between its resonant frequency and the trigger pulse frequency of the oscillator 15. The resonant frequency of the commutating circuit is not readily adjustable in a given ballast, but to provide for a substantial range of adjustment of the oscillator frequency would be a matter of ordinary skill and conventional design practice. Thus, for example, to diminish the amount of power consumed by a given lamp, the oscillator frequency can be adjusted downwardly to a certain extent in order to effect a corresponding increase in the impedance of the commutating circuit 12. It will be apparent that simple provision for a limited adjustment of oscillator frequency enables a ballast of this invention to be "tuned" for power consumption and/or illumination requirements imposed upon a particular lamp.

As a corollary, it will be evident that if oscillator frequency trimming is effected with the aid of a light-responsive device that is exposed to the illumination of the lamp, the level of illumination produced by the lamp can be maintained at a constant value notwithstanding power line voltage fluctuations and aging of the lamp. Thus the ballast of this invention lends itself to a type of regulation that is virtually essential in certain photographic and similar applications.

With load coils 11 of some configurations there is an indication of a high frequency ringing in the open-circuit condition whereby a part of the voltage waveform across the lamp terminals is somewhat distorted. This distortion, which is due to resonances in the commutating circuit, is of no significance in itself; but it has been found that if some correction of the wave form can be obtained, open circuit voltage across the lamp terminals can be increased. Where waveform distortion appears, correction can be effected, and higher open-circuit voltages can be obtained, by a redesign of the load coil. However, a correction that is less difficult to develop, equally effective, and relatively inexpensive consists in connecting a small capacitor 23 (typically 2800 μμf) across the terminals of the load coil to serve as a high frequency filter. Since a low pressure sodium lamp needs a higher voltage for starting than a mercury lamp, the inclusion of the capacitor 23 is particularly desirable in a ballast intended for low pressure sodium lamps. Since it has been found that under certain conditions the life of a mercury vapor lamp is shortened if it is started with the higher voltages obtained with the inclusion of the capacitor 23, that capacitor is preferably omitted to adapt the same ballast for use with mercury vapor lamps.

As illustrated in FIG. 1, energization of the lamp and ballast combination is controlled by a simple switch 23 at the connection of the a.c. mains 8 with the rectifier bridge 7. In many cases where the controlled lamp is used for outdoor illumination, the switching means 23 will be a photoelectric control unit that switches the lamp on and off automatically. Especially in such cases, the connection between the oscillator 15 and the gate of the thyristor 14 will comprise a time delay switching instrumentality 24, adjusted for a delay period long enough to prevent the light from being turned on by transient shadowing of the photoelectric unit and to ensure that the oscillator 15 is in stable operation. (Note that the oscillator is at all times connected with the d.c. terminals.) The time delay period of the device 24 should be several minutes if the ballast is to be used with a mercury lamp, to ensure ample cooling time for the lamp after a power interruption, inasmuch as an attempt to restart a hot mercury lamp can result in its destruction.

Figure 3:
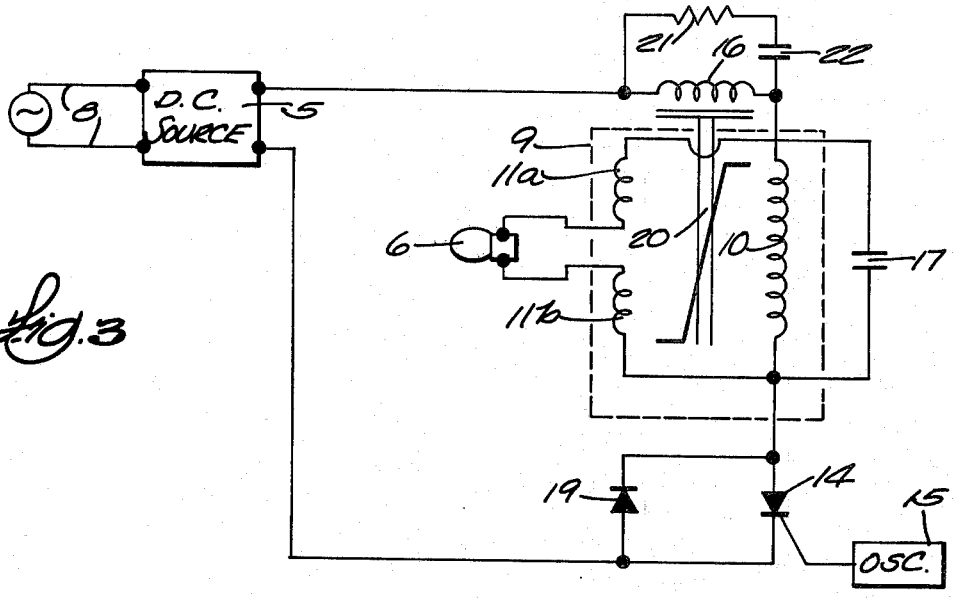
FIG. 3 is a circuit diagram of a modified embodiment of the ballast apparatus of this invention.

The circuit illustrated in FIG. 3, which can comprise the reactive regulating device illustrated in FIG. 4, is presented mainly to indicate the variety of embodiments to which the principles of this invention can be adapted. In the FIG. 4 circuit the reactive device comprising the voltage coil 10 is connected between the commutating reactor 16 and the thyristor 14, but those components are nevertheless again connected in series with one another and across the d.c. terminals. The capacitor 17 that is common to the commutating circuit and to the regulating circuit is shunted across the voltage coil 10 instead of being in series with it as in FIG. 1. Nevertheless, the capacitor 17 is again so connected with the voltage coil 10 that charging and discharging of that capacitor impresses an alternating voltage across said coil. The capacitor 17 is likewise again so connected with the thyristor 14 as to be discharged through that thyristor and to impress a back voltage across the thyristor in consequence of its being discharged. Furthermore, in the FIG. 3 circuit, as in that of FIG. 1, the capacitor 17 is so connected with the commutating reactor 16 as to cooperate with it in providing a resonant commutating circuit for the thyristor 14.

Connecting the capacitor 17 across the voltage coil 10, as in FIG. 3, appears to be as satisfactory as the series connection shown in FIG. 1 under normal conditions of lamp starting and lamp operation. However, in the short circuit condition the series connection is slightly superior in that the apparatus draws slightly less power from the line, and with the series connection there is a little less heating of the reactive device 9, due to the time delay in capacitor charging that results from the coils 10 and 11 (in parallel with one another) being in series with the capacitor. With the capacitor 17 shunted across the reactive device there also tends to be more of a problem with transient voltages in the circuit that might give rise to radio frequency interference.

The FIG. 3 circuit also differs from that of FIG. 1 in that the dV/dt clamp 21, 22 in FIG. 3 is shunted directly across the commutating reactor 16 instead of being in series with that reactor and shunted across the thyristor 14.

FIG. 5 illustrates further modifications that can be made in circuitry embodying the principles of this invention. In this case the lamp 6 and its socket are effectively isolated, by means of a transformer coupling, from the line mains 8, the d.c. source 5 and the commutating circuit 12, thus providing a measure of safety for a person replacing the lamp bulb or otherwise working at the lamp socket. In the FIG. 5 apparatus, the voltage coil comprises two parts 10*a*, 10*b* that are inductively coupled with one another by means of a core or core portion 35 which provides for a transformer relationship between them. Part 10*a* of the voltage coil serves as the transformer primary and is directly connected with the thyristor 14 and the capacitor 17, its connection with that capacitor being shown as a series connection in this case. Part 10*b* of the voltage coil serves as the transformer secondary, across which is connected the load coil 11 in series with the lamp 6. Effectively, the transformer-coupled voltage coil parts 10*a*, 10*b* function the same as the simple voltage coil 10 in FIG. 1; hence the term "coil" is used herein to denote both the transformer-coupled arrangement such as is shown in FIG. 5 and the simple coil arrangement such as illustrated in FIG. 1.

As FIG. 5 also illustrates, the commutating reactor can comprise two-transformer-coupled coil parts 16*a*, 16*b*, and the dV/dt clamp 21, 22 can be connected across the coil part 16*b* which serves as the transformer secondary, to be inductively coupled with the coil part 16*a* in a clamping arrangement functionally identical with the dV/dt clamp connection shown in FIG. 3. Although not so shown in FIG. 5, it will be understood that the commutating reactor 16*a*, 16*b* could be wound, in whole or in part, on a common core with the load coil 11 to interact with it as described above.

From the foregoing description taken with the accompanying drawings it will be apparent that this invention provides a light and compact but nevertheless inexpensive and unusually efficient lamp ballast that is particularly suitable for mercury arc and low pressure sodium lamps which are rated at up to about 100 watts. It will also be evident that the ballast of this invention lends itself to a variety of embodiments so that it can be readily modified as necessary to accommodate changes in cost relationships as between labor, materials and various components.

Those skilled in the art will appreciate that the invention can be embodied in forms other than as herein disclosed for purposes of illustration.

The invention is defined by the following claims:

I claim:

1. Ballast apparatus for a lamp that has a pair of terminals across which there must be a high voltage during a starting period but for which current limiting is required during subsequent operation, when impedance across said terminals is substantially lower than during the starting period, said ballast apparatus being characterized by:

A. a load coil;

B. a voltage coil;

C. means connecting said coils in a regulating circuit having parallel branches, (1) one branch comprising said voltage coil and (2) the other branch comprising said load coil in series with the terminals of the lamp;

D. a capacitor connected with said regulating circuit for impressing an alternating voltage across the voltage coil in consequence of the capacitor being alternately charged and discharged; and E. means comprising solid state switching means connected with the voltage coil, the capacitor and a source of direct current, for alternately charging and discharging the capacitor at a frequency of several KHz.

2. The ballast apparatus of claim 1 wherein said solid state switching means comprises a thyristor, and wherein said means for alternately charging and discharging the capacitor comprises:

(1) oscillator circuit means connected with said thyristor for issuing trigger pulses thereto at said frequency;

(2) a commutating reactor connected in series with said thyristor, the voltage coil and the terminals of the direct current source, and also connected with said capacitor, to provide for discharge of the capacitor through the thyristor and for impressing a back voltage across the thyristor by which the thyristor is commutated after a period of discharge of the capacitor; and (3) a diode connected across the thyristor to conduct back current across it after the thyristor has been commutated.

3. The ballast apparatus of claim 2, further characterized by (4) a resistor and a capacitor that are connected in series with one another to provide a voltage rise clamp which is in turn connected with the thyristor and the commutating reactor to limit the rate of rise of back voltage across the thyristor.

4. The ballast apparatus of claim 1, further characterized by:

said load coil and said voltage coil being inductively coupled with a core and being so arranged in relation to the core and to one another that current through the load coil increases the effective impedance of the voltage coil.

5. Ballast apparatus for a lamp that has a pair of terminals across which there must be a high voltage during a starting period but a substantially lower voltage during subsequent operation, said ballast apparatus being characterized by:

A. a load coil;

B. a voltage coil;

C. means connecting said coils in a regulating circuit having parallel branches, (1) one branch comprising said voltage coil and (2) the other branch comprising said load coil in series with the terminals of the lamp;

D. a commutating reactor having an inductance substantially lower than that of each of said coils;

E. a thyristor having a gate terminal and anode and cathode terminals;

F. triggering circuit means connected with the gate terminal of said thyristor, said triggering circuit means being arranged to issue pulses of triggering current to the thyristor at substantially regular intervals;

G. means connecting said regulating circuit, the commutating reactor and the thyristor in series with one another and across the terminals of a d.c. source;

H. a capacitor (1) connected with the regulating circuit to be charged therethrough and to impress an alternating voltage across the voltage coil in consequence of its alternate charge and discharge, (2) said capacitor being also connected with said thyristor and said commutating reactor in a resonant commutating circuit, (a) to be discharged through the thyristor in consequence of triggering thereof and (b) to cooperate with the commutating reactor in impressing a back voltage across the thyristor by which the thyristor is commutated; and I. means connected in said commutating circuit for conducting back current across the thyristor upon commutation thereof.

6. The ballast apparatus of claim 5, further characterized by:

J. a magnetically permeable core with which said load coil and said voltage coil are inductively coupled, said coils being so arranged in relation to said core and to one another that current through the load coil tends to increase the impedance of the voltage coil.

7. The ballast apparatus of claim 6, further characterized by:

K. said commutating reactor being inductively coupled with said core and so arranged in relation to said core and to the load coil that current through the commutating reactor increases the effective impedance of the load coil and current through the load coil increases the effective impedance of the commutating reactor.

8. The ballast apparatus of claim 5, further characterized by:

J. a magnetically permeable core with which said load coil and said commutating reactor are magnetically coupled and on which they are so arranged that current through the load coil increases the effective impedance of the commutating reactor.

9. The ballast apparatus of claim 5, further characterized by:

J. said pulse circuit means having a pulse frequency which is between 13 KHz and 25 KHz; and K. the resonant frequency of said commutating circuit being between 1.2 and 3 times said pulse frequency.

10. The ballast apparatus of claim 5 wherein said means for conducting current across the thyristor upon commutation thereof comprises a fast recovery diode.

11. The ballast apparatus of claim 5 further characterized by:

J. resistance-capacitance voltage rise clamping means connected in said resonant commutating circuit for limiting the rate of rise of back voltage across said thyristor upon commutation thereof.

12. Ballast apparatus for a lamp that has a pair of terminals across which there must be a high voltage during a starting period but for which current limiting is required during subsequent operation, when impedance across said terminals is substantially low, said ballast apparatus being characterized by:

A. a reactive voltage and current regulating device connected with said lamp terminals;

B. a capacitor connected with said reactive regulating device to impress a voltage thereacross that alternates with charge and discharge of the capacitor;

C. a thyristor having a gate terminal and having a pair of other terminals between which current can flow in a forward direction in consequence of delivery of a pulse of triggering current to said gate terminal; said other terminals being connected in a circuit with the capacitor whereby a cycle of charge and discharge of the capacitor is initiated by each such delivery of a pulse of gate current;

D. triggering circuit means connected with said gate terminal of the thyristor and arranged to deliver triggering current pulses thereto at a pulse frequency on the order of several KHz;

E. resonant circuit means comprising a commutating reactor having an inductive impedance substantially lower than that of said reactive device, said resonant circuit means being connected with said capacitor and said thyristor in a commutating circuit whereby the thyristor is commutated during each of said cycles by a back voltage across it, said commutating circuit (1) having a resonant frequency which is between 1.2 and 3 times said pulse frequency and (2) further comprising semiconductor means for conducting back current across the thyristor upon commutation thereof; and F. means for connecting said reactive regulating device, said commutating reactor and said thyristor, in series with one another, across the terminals of a source of direct current.

13. The ballast apparatus of claim 12, wherein said semiconductor means comprises a fast recovery diode.

14. The ballast apparatus of claim 12, further characterized by:

G. resistance-capacitance voltage rise clamping means connected with said commutating reactor to limit the rate of rise of back voltage across the thyristor upon commutation thereof.

15. The ballast apparatus of claim 12, further characterized by said reactive voltage and current regulating device comprising:

(1) a load coil connected in series with said lamp terminals in a branch circuit;

(2) a voltage coil connected in parallel with said branch circuit; and (3) a magnetically permeable core with which said coils are inductively coupled and which so cooperates with said coils that current in the load coil increases the effective impedance of the voltage coil.

16. Ballast apparatus for a lamp that has a pair of terminals across which there must be a high voltage during a brief starting period but which requires current limiting during subsequent operation when the impedance between said terminals is substantially lower than during starting, said ballast apparatus comprising:

A. a voltage coil having a substantially high impedance;

B. a commutating reactor having a substantially lower impedance;

C. clock circuit means providing a source of current that is pulsed at a frequency of several KHz;

D. thyristor having a gate terminal connected with said clock circuit means so that the thyristor can be triggered into forward conductivity by each pulse of current from the clock circuit means;

E. means connecting said voltage coil, said commutating reactor and said thyristor in a series circuit that is connectable across the terminals of a direct current source;

F. a capacitor (1) so connected with said voltage coil that a cycle of alternate charge and discharge of the capacitor impresses an alternating voltage across the voltage coil, and (2) connected with said thyristor and said commutating reactor in a resonant commutating circuit that permits one portion of said cycle to occur in consequence of current flow through the thyristor during forward conductivity thereof and causes a back voltage to be impressed across the thyristor by which the thyristor is commutated after a period of forward conductivity;

G. a load coil having an impedance higher than that of said commutating reactor but lower than that of said voltage coil; and H. means for connecting said load coil, in series with the terminals of a lamp, in parallel with said voltage coil so that the alternating voltage across the voltage coil is impressed across the series-connected load coil and lamp.

17. The ballast apparatus of claim 16, further characterized by:

the capacitance of said capacitor and the impedance of said commutating reactor being such that the resonant frequency of said commutating circuit is between about 1.2 and 3 times the pulse frequency of the clock circuit means.

18. The ballast apparatus of claim 17, further characterized by:

(1) a fast recovery diode connected across the thyristor in said commutating circuit, for conducting back current across the thyristor after commutation thereof; and (2) a resistance-capacitance voltage rise clamp in said commutating circuit for limiting the rate of rise of back voltage across the thyristor.

19. The ballast apparatus of claim 16, further characterized by:

(1) said commutating reactor comprising a coil that is inductively coupled with a core;

(2) said load coil and said voltage coil also being inductively coupled with said core; and (3) said commutating reactor coil, said load coil and said voltage coil being so arranged in relation to said core and to one another that the load coil interacts with one of said other coils to cause an effective increase in the impedance of said one of the other coils in consequence of flow of current through the load coil.

* * * * *